United States Patent [19]

Valenzano

[11] Patent Number: 4,550,543

[45] Date of Patent: Nov. 5, 1985

[54] CONSTRUCTION FORMS

[76] Inventor: Marcello Valenzano, 154-09 33rd Ave., Flushing, N.Y. 11354

[21] Appl. No.: 569,040

[22] Filed: Jan. 9, 1984

[51] Int. Cl.[4] ..... E04C 1/39; E04C 2/52

[52] U.S. Cl. ..... 52/309.7; 264/46.5; 52/591; 52/593; 52/586; 52/612

[58] Field of Search ..... 52/591, 593, 437, 438, 52/306, DIG. 16, 309.7, 100, 586, 612; 446/127; 264/46.5, 46.6, 46.4

[56] References Cited

U.S. PATENT DOCUMENTS

| | | | |
|---|---|---|---|
| 1,323,514 | 12/1919 | Whitacre | 52/437 |
| 2,472,363 | 6/1949 | Blackinton | 446/127 |
| 2,591,906 | 4/1952 | Altmann | 52/100 |
| 2,737,801 | 3/1956 | Barnhart | 52/100 |
| 3,989,562 | 11/1976 | Hladik et al. | 264/46.5 |
| 3,992,834 | 11/1976 | Valenzano | 52/594 |
| 4,035,539 | 7/1977 | Luboshez | 52/DIG. 16 |
| 4,038,798 | 8/1977 | Sachs | 52/309.7 |
| 4,326,012 | 4/1982 | Charlton | 52/306 |

FOREIGN PATENT DOCUMENTS

| | | | |
|---|---|---|---|
| 1485237 | 5/1967 | France | 52/DIG. 16 |

*Primary Examiner*—James L. Ridgill, Jr.
*Attorney, Agent, or Firm*—William V. Pesce

[57] ABSTRACT

Construction forms for the erection of structural assemblies utilizing a variety of extruded or cast individualized building forms in a combined array to define a single structure composed of standard forms having a plurality of cells with the ends thereof biased to include 45° male-female miter elements. Also included are accessary forms having at least one biased termination end which includes male-female miter being disposed to impart dual direction to the extruded form. Within the said forms there are structural supports for reinforcing the forms while at the same time allowing the forms to carry utility conduits and supports for cables, insulation, air, water, gas, etc.

4 Claims, 36 Drawing Figures

1
2
3
4
5
6
7
8
9
10
12
120
122
124
212

154
152
146a
154

156
150
152
148
146
154

196
206
208
198
202
204
200

210
211
209

210
209

162
172
166
172
170
174
172
168
174
172
174
160
164

6
18
14
15
15a
16
6

6
18
15a
6
15
16
14

80
82
84
86
90
92
74
100
102
103
104
105
106
108
110
112
114
116
118
120
122
126
128
130
132
134
136
138
140
142
144
146
148
150
152
45°

CONSTRUCTION FORMS

This invention relates to extrudable construction forms which in combination with each other produce pre-fabricated structures such as wells, floors, ceilings, roof for homes, commercial buildings, airports, bridges, tunnels, retaining walls and other related structures.

Another object of the invention is to provide construction forms which are easily and conveniently used to create any variation in walls, floors, ceilings and etc.

Another object of the invention is to provide construction forms whose interval members are utilized for not only strengthening the form, but also providing said forms with means for carrying and transmitting electrical lines, fluids, air and other transportable items.

Another object of the invention is to provide integral heat and cold insulation, electrical insulation and radio wave insulation, with the said features imparting further structural strength and ridgidity to the forms.

Another object of the invention is to provide a repetitive V-groove along the surface and at its overlapping junctures. Causing the joints to be hidden.

Another objective of the invention is to provide a mitered joint which adds to the structural rigidity of the assembly while allowing for expansion and contraction making for optimum water and air seal at the bondable junctures.

Another object of the invention is to provide a keyed joint at the apex of the V-groove juncture which will accomodate a flexible membrane sealant such as silicone.

Still another object of the invention is to provide construction forms which also become solar cells for the production of energy to the structure erected by the construction forms.

Further objects and advantages will become apparent from a reading of the specifications and a study of the accompanying drawings.

BRIEF DESCRIPTION OF THE DRAWINGS

FIG. 1(*a*) shows a structure having several of the standard forms according to the invention.

FIG. 1(*b*) is similar to FIG. 1(*a*) but uses several of the same forms in a different configuration to create a structure similar to FIG. 1(*a*).

FIGS. 3(*a*), 3(*b*) shows accesory units and different directional changes using the standard form.

FIG. 7(*a*) is a standard form comparable to FIG. 6 with the inner and outer wall members having the same thickness.

FIG. 7(*b*) is a form similar to FIG. 7(*a*) in which two additional cross-ribs have been added along with the supporting arched brackets running along each wall to give support to the other wall comparable to a bridge-span.

FIG. 8(*a*) is a form having end terminations in angles to give a trapazodal shape having male-female miter ends to permit a square-like configuration where several of these forms are connected as in FIG. 2 or a double wall termination as in FIG. 8(*b*).

FIG. 8(*b*) shows a conduit or tunnel-like shape when using the forms as in FIG. 8(*a*).

FIGS. 10(*a*), 10(*b*), 10(*c*) are right angle-termination accessory forms whose miter end is female.

FIGS. 11(*a*), 11(*b*), are various male spline forms disposed to change female miters to make male miters when inserted in the various forms.

FIGS. 14(*a*), 14(*b*) shows other accessory forms which change the wall angle to a lesser degree than that shown in FIG. 13, the ends terminating in a 45° miter.

DETAILED DESCRIPTION OF THE DRAWINGS

Figures 7A, 8A, 9, 10A, 11A, 11B, 12, 13:
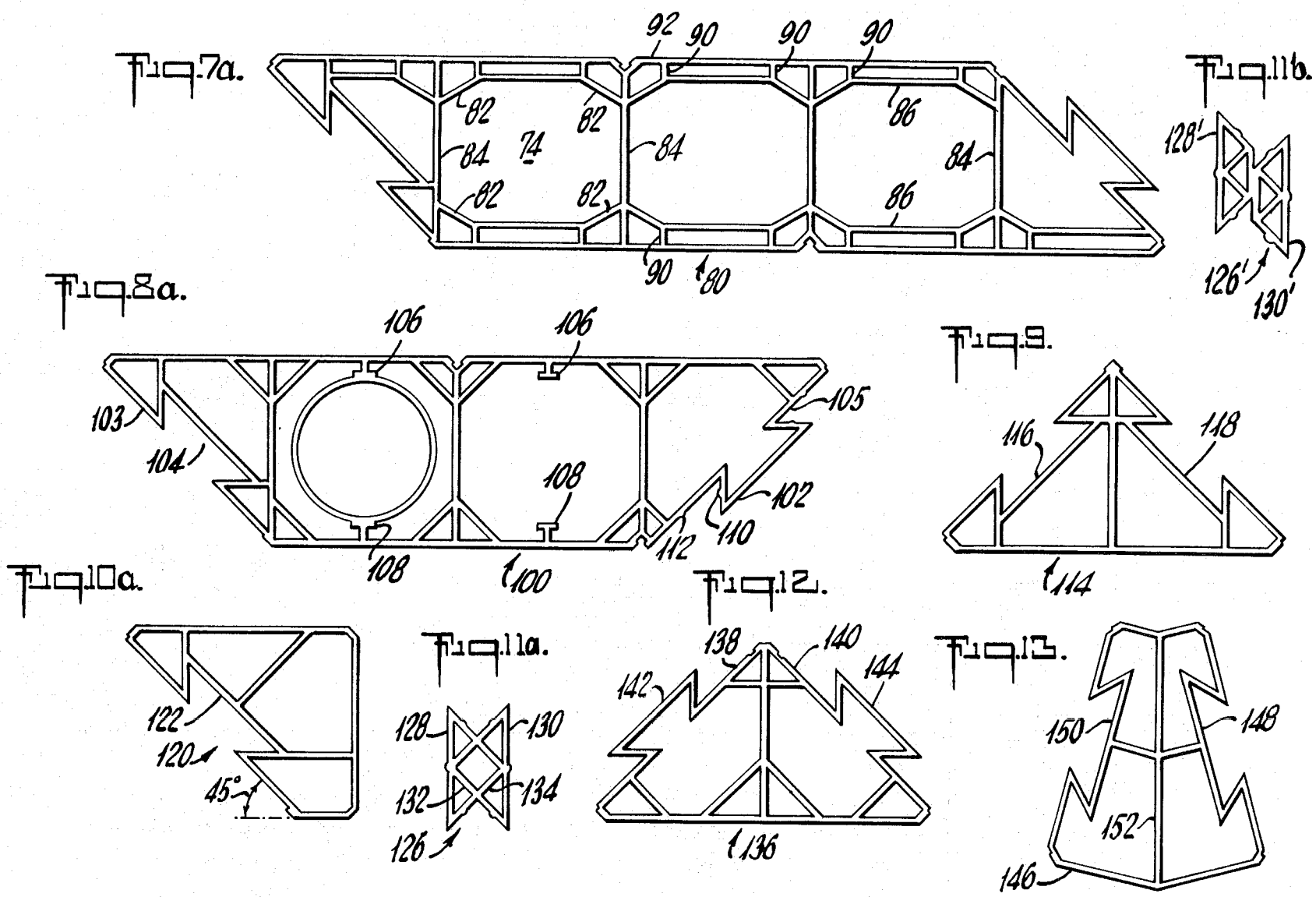
FIG. 9 is a triangularly-shaped accessory unit whose miterends are female.
FIG. 12 is an accessory form comparable to FIG. 9 with malemiter terminations.
FIG. 13 is an accessory form for changing the wall angles when combined with the standard forms.

Now describing the drawings with more particularity, marking like parts with the same reference members there is shown in FIGS. 1(*a*) and 1(*b*) an assembly of different forms which define the invention. In particular there is shown in FIG. 1(*a*) a standard form 1 having 45° terminations 2, 3 each terminating in female 4, male 5 configurations. Further, one wall side 6 has an end termination accessory form 7 having a female slot 8 disposed to engage the male miter 9 which terminates one end of the standard form 1. FIG. 1(*b*) is an assembly comparable to FIG. 1(*a*) but with intermediate accessories such as triangular form 10 which has male terminations as shown in FIG. 9 to be described. Also forming a part of the assembly of FIG. 1(*b*) is the use of a form 12, as shown in FIG. 8 to be described that has sloping ends to give the form a rhombic configuration. There are any number of wall assemblies which can be designed using a combination of the standard forms and the accompanying accessory forms to be further described herein.

Figure 4:
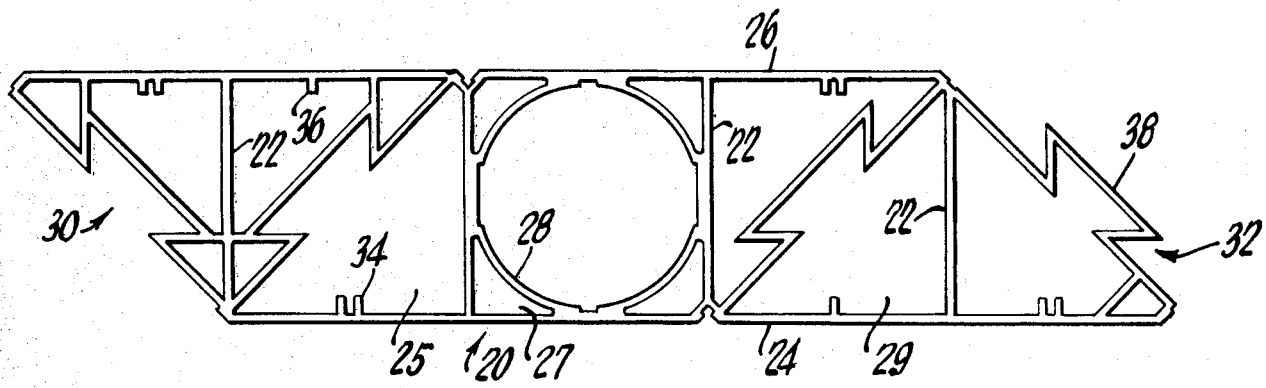
FIG. 4 shows a standard form, rhombic in configuration, having male and female terminations or miter supports integral to the interior of the forms to form individual cells.
Figure 5:
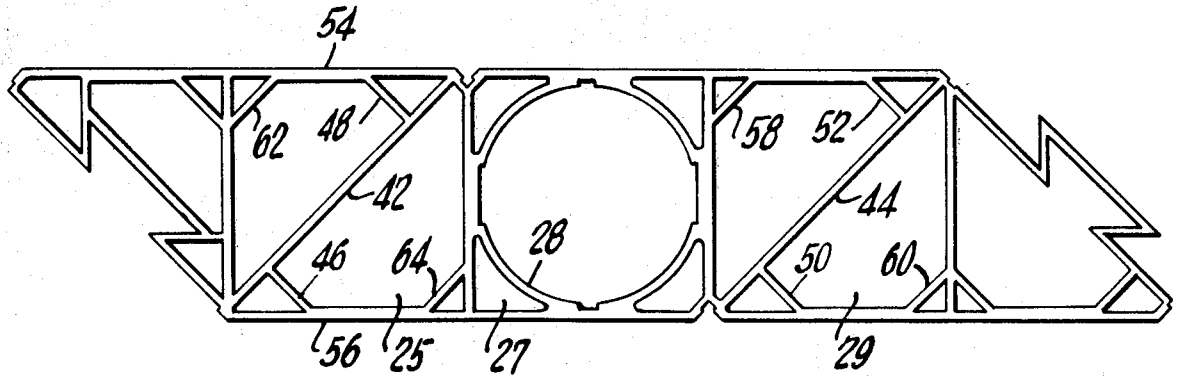
FIG. 5 shows a form comparable to FIG. 4 with both interval and diagonal members varying therefrom such as the diagonal members of FIG. 4 having miters with 45°, Ribs to the outer walls.

FIG. 5 is comparable to FIG. 4 in configuration except as to the internal structure. In particular there are a pair of diagonal members 42, 44 with additional brackets 46, 48 and 50, 52 at the extremities of the said members 42, 44 to provide further support to the outer walls 54, 56. Additional corner bracket support members 58, 60, 62, 64 in cells 25, 29 are provided to give additional support to the outer walls of the construction form 20. It can be appreciated that this configured form containing the aforementioned bracket members provides additional rigidity to the construction form. In particular the outer wall surface is structurally reduced by at least a third to permit greater support therefor by the additional support brackets.

Figure 6:
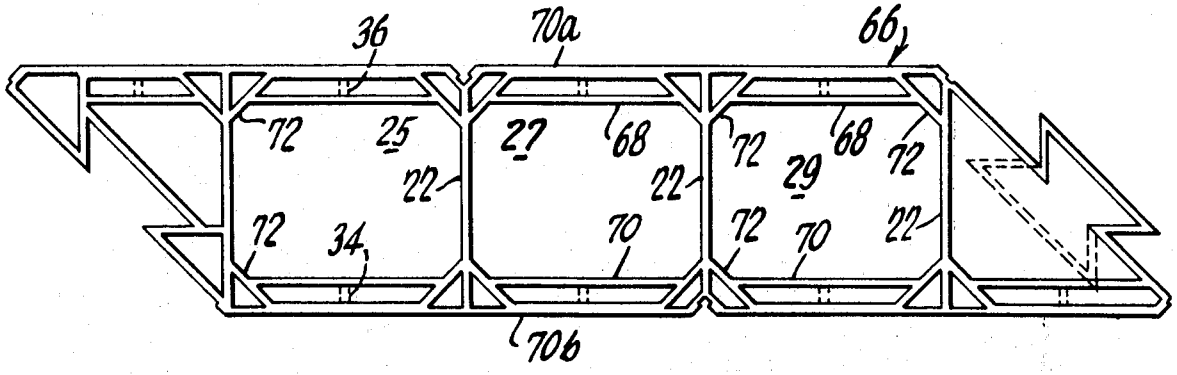
FIG. 6 is a form comparable to FIG. 4 with internal members varying therefrom along the upper and lower internal surfaces creating three self enclosed areas.

Referring to FIG. 6, there is still another construction form 66 again configured as per FIG. 4 but having internal supports which are different. In particular form 66 contains another internal wall structure having parallel brackets 68, 70 running parallel to the outer walls 70(*a*), 70(*b*) in each of the cells 25, 27, 29 with each intercepting corner brackets 72 within each of the said cells. The said cells are each separated by upright members 22. The supports 68, 70 and 72 provide additional support comparable to a beam to the outer walls, thereby giving the outer walls additional strength and an effective thickness increase. Additionally running along the inner wall are parallel studs or beads 34, 36 as per FIG. 4 which adds additional strength to the wall along its length.

Figures 1A, 1B, 2, 8B, 10B, 10C:
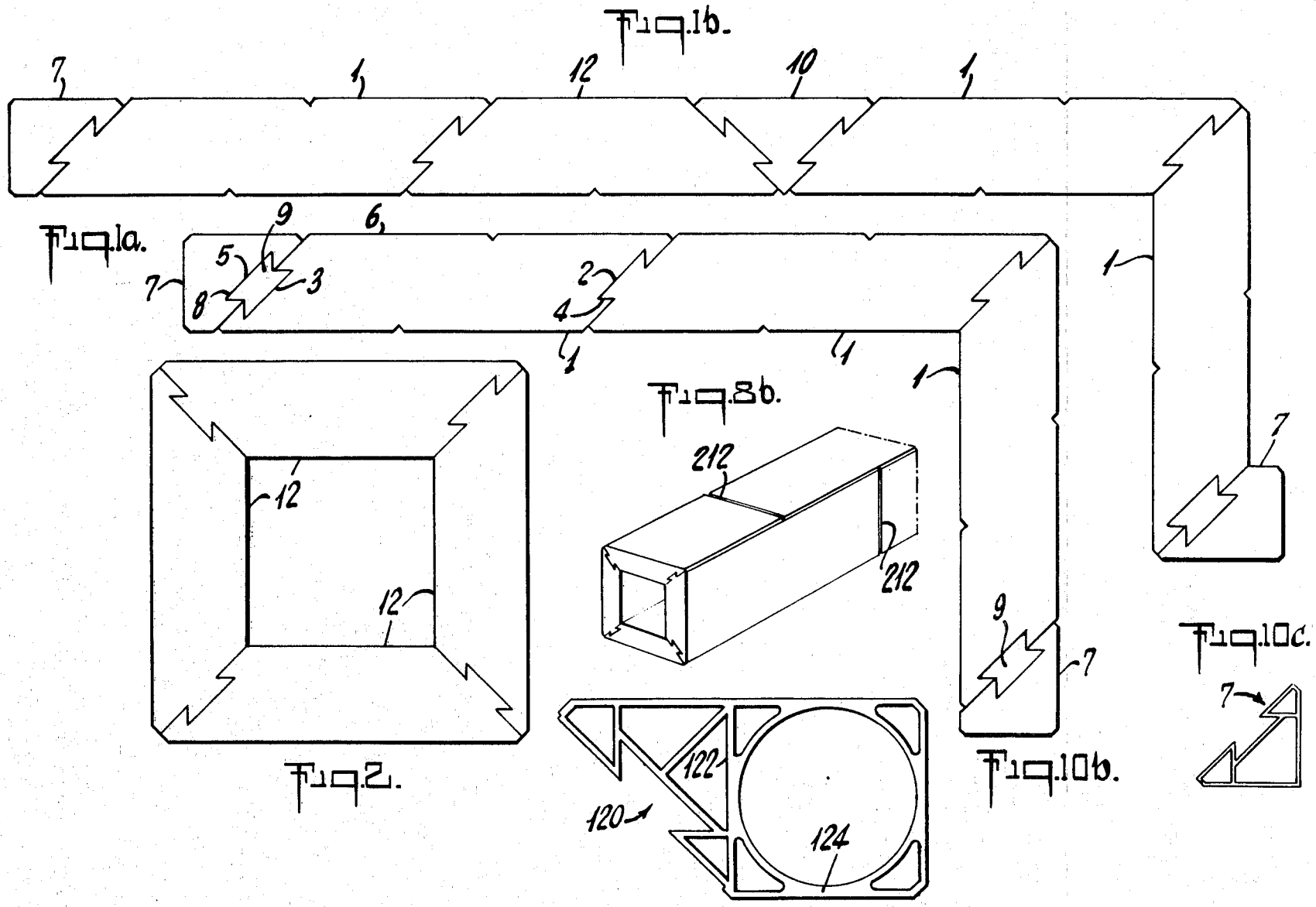
FIG. 2 shows a combination of forms illustrated in FIG. 8 to produce a square structure, such as a continuous conduit or tunnel.

In FIG. 7(*a*) there is shown still another structural form 80 again as per FIG. 4 but having a modified internal configuration. In particular this form contains cells 25, 27 and 29 as per FIGS. 4 and 6 but with corner brackets 82 each having one extremity in parallel supports 86, their terminion point 88, having a small bracket 90 attached thereto that terminates in the wall 92 which forms a part of the construction form 80. It can be seen FIG. 2 is an assembly of the forms shown in FIG. 8 which gives a square structure desposed to be confined to a space square in configuration. Also this arrangement can be used, as shown in FIG. 8(*b*) to provide a conduit or tunnel for transport of variance items.

FIGS. 3(*a*), 3(*b*) show a directional change accessory unit 14 (with 45° miters), having female termination 15, 15(*a*) for receiving the male terminations 16, 18 of standard forms 1 as shown in FIG. 1. These accessory units make it possible to change the wall angles in a very convenient way thereby giving greater flexibility in the erection of the walls, ceilings, and etc.

Now referring to FIG. 4 which is a basic configuration of standard form 20 similar in size and shape to FIG. 1 in the U.S. Pat. No. 3,992,834 issued to the applicant herein. However, the internal structure of form 20 is quite different than the form of the patent above recited. FIG. 4 shows a series of spaced vertical upright members 22 between the walls 24, 26 defining cells or compartments 25, 27, 29 of the form 20 to render strength and stiffness to the structural form 20. Between a pair of the upright members 22, at the central part of the form 20, a conduct 28 is attached to the walls and uprights in cell 27 to provide additional strength to the building form 20. It can be seen that the form 20 terminates at both extremities in triangular members 30, 32 each configured as in FIGS. 9 and 12 respectively. Additionally there are parallel studs, 34, 36 singular or dual running the length of the form 20 to provide strength in the direction of the wall length. The extremities of the form 20 terminate in a male 38 female 40 tongue and groove arrangement or miter. A male and female miter also form the inter-ribbing in the form. here that the wall thickness, because of the internal structural bracket arrangement, has a thickness less than that shown in FIG. 6 thus showing that this arrangement provides comparable wall strength without the need of thickening the walls. The configuration shown in FIGS. 6 and 7(*a*) provide additional means for not only stiffening the wall panels, but also for transporting various items such as conduit, wiring and etc.

FIG. 7(*b*) is similar to FIG. 7(*a*) except for the additional brackets 83, 85 in cells 25, 27 and the variations in brackets 82 and supports 84.

There is now shown in FIG. 8(*a*) another type construction form 100 which terminates in male 102 and frame 104 miters or tongue and groove parts. This form provides maximum internal space for the drawing of cables, air, and other extraineous items. Additionally the form 100 carries along the interior walls thereof T-ribs 106, 108 to give a structural integrated I-beam effect thereby rendering considerable strength to the structural form 100. Further, the ribs make it possible to effectively reduce the wall-span size between cells thus giving added stiffness to the span and making it possible to increase the load on the structural forms and the walls forming a part thereof. There is also associated with this form end sections 103, 105 whose sides are askew to each other, that is they form sides which give the structural form a rhombic configuration. The standard form previously identified has its extremities parallel to each other. At the termination 102 of the form 100 there is provided special beaded elevation portions 110, 112 along the inner faces of the tongue and groove members to assure a suitable fit between forms and to assure that there is no slippage or tolerance which make for play or a loose fit between forms. With these elevations a snug match is assured for all tongues and groove parts.

FIG. 8(*b*) shows a structure made of the forms of FIG. 8(*a*) combined as in FIG. 2 produce a continuous boxed-like conduit configuration with staggered joints 212 along the exterior surface. This tunnel-like form can be used to carry additional utility means.

There are several accessory forms shown in FIGS. 9–14 which are for the purposes of changing directions of the structural forms or to create different styles, shapes and configurations of the whole wall assembly which could not otherwise occur. These accessory units make it possible to style walls and assemblies for different needs and requirements. In particular as shown in FIG. 9, a triangular structural member 114 has a pair of female miter ends 116, 118 for accommodating any male miter which terminates any of the aforementioned forms. The member 114 makes it convenient to change directions of the structural forms by ninety degrees creating considerable versatility in the erection of any structure.

FIG. 10(*a*) is an end termination 116 which finishes off a wall leaving no biased end termination which is the case when a standard form is used. The end termination 116 has a female miter 118 biased at an angle of forty-five degrees and so desposed as to accommodate the bias of the standard form at the male end thereof. A comparable end member 120 of FIG. 10(*b*), has added to it, along one of the right-angled sides 122, a single cell 124 which can be used to terminate one of the standard forms, but where an additional length is desired or necessary.

FIG. 11(*a*) is a form 126 comparable to a spline, and is in reality a pair of male miters 128, 130 back-to-back. This form can be made either solid or can be structured to have cross-bracing 132, 134 to achieve the required strength. The form can be used to change end terminations, from female to male and thus give further versatility to the erection of walls and other structures. Another accessory form 136 is shown in FIG. 12 and is similar to FIG. 9 in that it is triangular in configuration, but is differentiated therefrom in that the biased sides 138, 140 have male terminations, 142, 144 suitable to engage female miters whenever the occasion arises.

FIGS. 13, and 14 show accessory units 146(*a*) and 146(*b*) in which a pair of female miters 148, 150 are structured to have a common base 152 with the miters themselves on a bias so that when standard forms 154, 156 attached, the walls project outward from said accessory at a relatively narrow or broad angle from each other. When the standard forms 154, 156 are rotated, the walls project outward at a relatively large angle. The said figures clearly teach this.

The structural accessary forms 110, 118, 126, 136, and 146 are deemed miter arrangements which changes the end terminations from male to female and permit a greater versatility in the erection of walls, floor, roofs, and etc. making it very easy and time saving in erections and saving costs at all levels of construction.

Figures 3A, 3B, 14A, 14B, 15, 19, 20, 21:
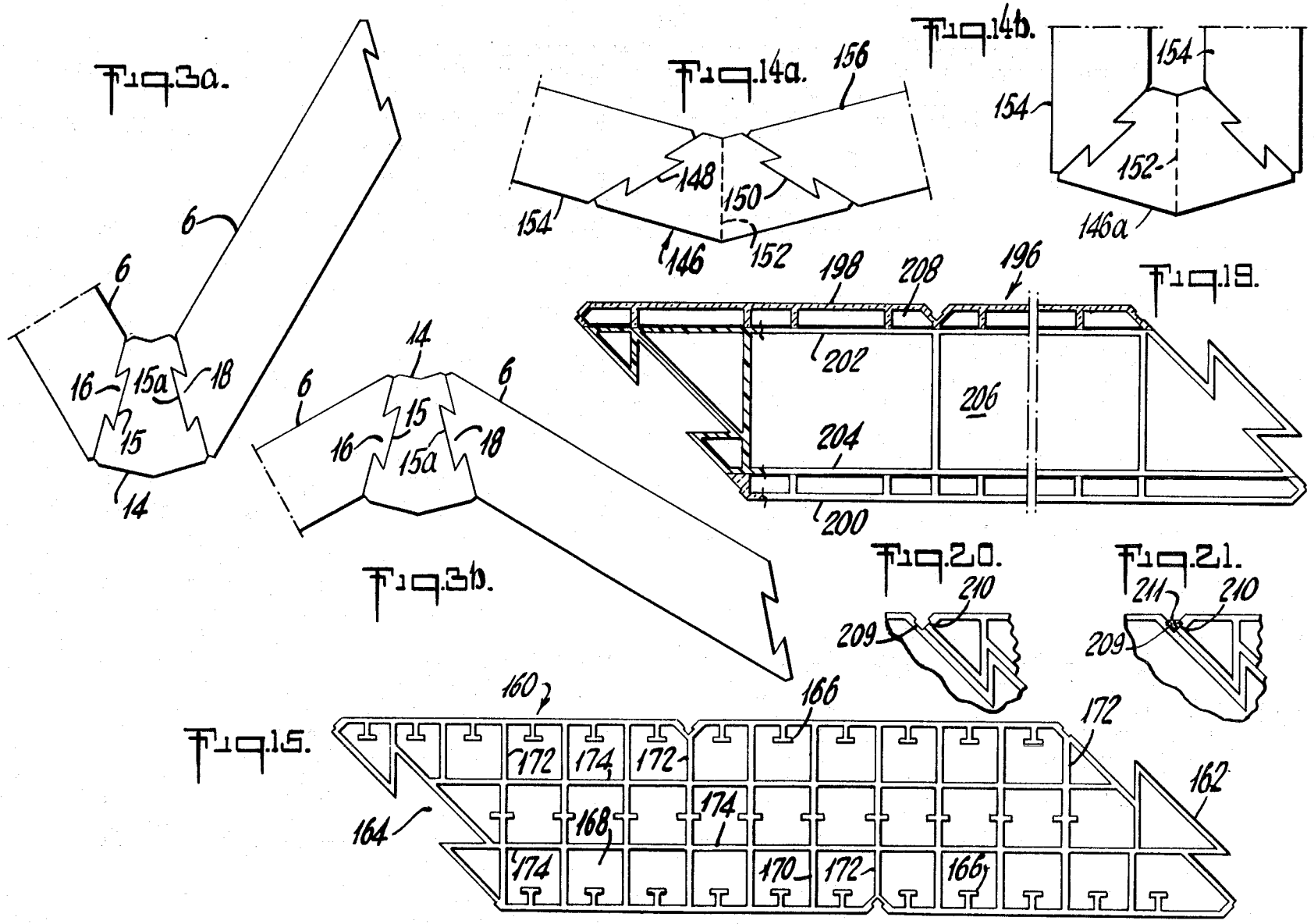
FIG. 15 shows a standard form unit with internal vertical walls for strengthening the forms and includes T-shapes spaced along the inner walls to stiffen the outer walls for the support thereof.
FIG. 19 is a standard form according to the invention but that the said form has solar means for converting the form into a solar collector via a clear outer surface.
FIG. 20 shows a typical V-groove between the juncture of two sections with keying channels along an apex of said groove.
FIG. 21 shows a termination as per FIG. 20 with a specific sealing bead within said termination to form a keyed in seal between the juncture of the two sections.

There is shown in FIG. 15 still another construction form 160 having the termination thereof end in male 162 and female 164 miters. However, the internal structure differs in that a number of features are added for further strengthening the building form 160. There is in particular a series of spaced apart T-shaped protruding members 166 forming an integral part of the internal walls of the form 160. In particular these protruding members 166 with the walls gives an I-beam effect to the said walls thereby rendering greater rigidity and strength to the form 160. Also the compartmentilized cells 168 have therein added additional ribs 170 which reduces the span between the original sectional uprights 172 thereby effectively reducing the wall span between the original uprights and thereby increasing the wall strength. Also parallel to the wall structure, additional elongated or horizontal spans 174 can be added to give the uprights greater strength and protection thereby increasing the overall strength of the form 160. Also the arrangement as shown in FIG. 15 provides for greater facility in the addition or ancillary services such as the addition of wiring, pipes, and etc. within the cell structure.

Figures 7B, 16, 17, 18:
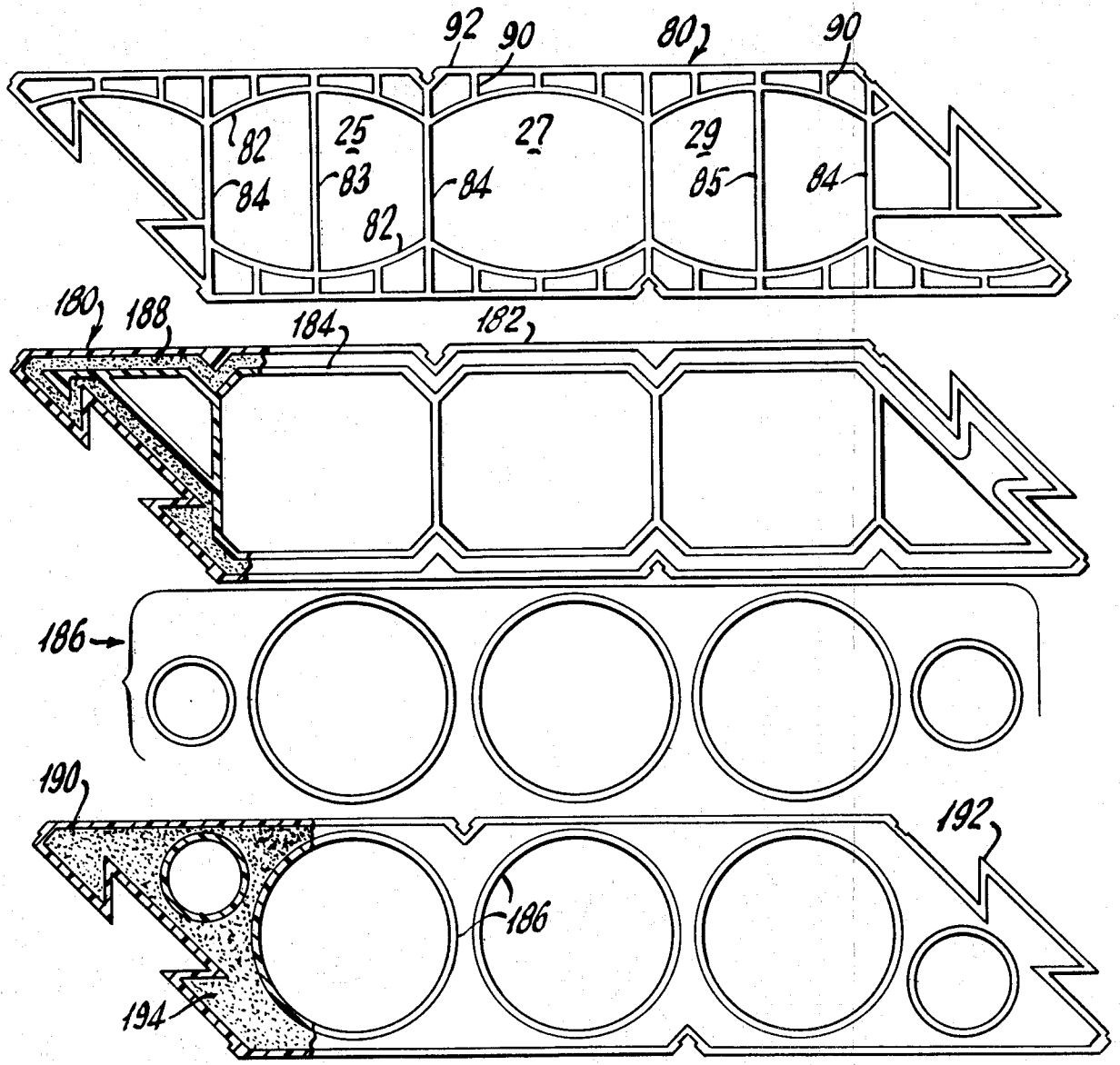
FIGS. 16–18 shows separately extruded forms which when combined form a single integrated unit foamed together.

The description above gives information relative to certain embodiments of the invention, but it can be appreciated that additional changes can be made in the embodiments presented without departing from the true scope of the said invention. For example, as shown in FIGS. 16 through 18 there are separately extruded forms which when combined form a single integrated unit. In particular in FIG. 16 there is shown an outer standard form 180 and a separately extruded form 182 internal to the outer form and which mirrors said form throughout with the exception that the inner shape does not include the ribs 184 which form said integral part of the main form or frame. The inner member 182 may contain all of the internal brackets and supports, and includes the formation of separately compartmentalized conduits 186 for the transmission of cables, fluids and etc. previously described. The area 188 between the outer and inner forms 180, 182 consists of a void which can be filled with any suitable filler such as foam which upon solidification renders the combined unit more rigid and makes for a better insulator.

FIG. 17 shows an insert configured in any desirable form and made from any desirable material such as plastic, metal and etc. with the void between the main form or frame and the insert filled with any suitable material. Here, there is no limitation such that the insert must mirror the main frame or form. This is shown clearly in FIG. 18 when the insert 190 and the main frame 192 are held in place by the addition of a suitable filler 194 although not mirrored to each other.

FIG. 19 shows the usual standard form 196 except that the said form can be made into a solar cell depending on the location and use of the form. For example, the said form 196 can be extruded in such a way that the outer walls 198, 200 are made from clear material and the inner walls 202, 204 are made relatively darker or black, the combination of the walls 198, 202, and 200 and 204 would be effective solar cells, the walls 202, 204 being collectors. Thus the form may contain in each cell 206 a series of conduits 208 for carrying items or fluids to be heated via the solar effect generated by the solar cells. The cells 206 and the conduit area 208 may be made into many combinations to give the solar effect above referred to. FIG. 20(*a*) shows the V-groove between the juncture of two sections with keying channels 209 and 210 at the apex of the groove. FIG. 20(*b*) shows a membrane caulking bead 211 ensconsed in the channels at apex of V-groove to key in said membrane.

Figure 24:
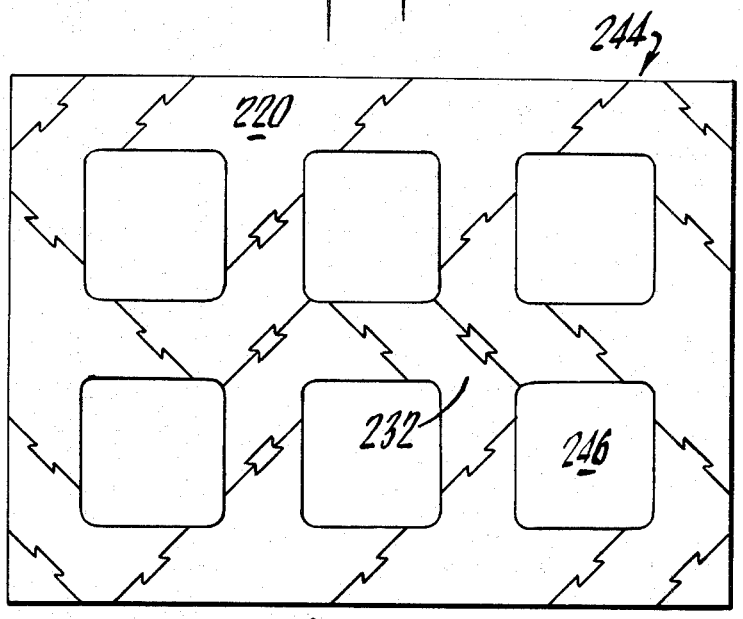
FIG. 24 shows the form of FIGS. 22 and 23 in an array to provide a plurality of conduits or tunnels structures.
Figure 22:
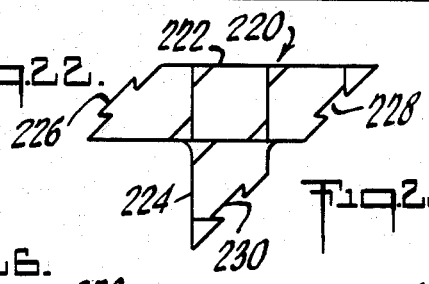
FIGS. 22 and 23 are accessory forms and in particular they are T-shaped and L-shaped respectively for changing the direction or configuration of the standard form.
Figure 23:
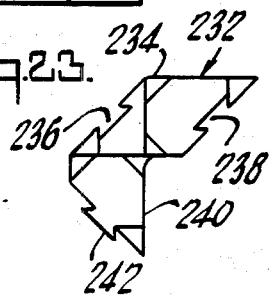
Figure 25:
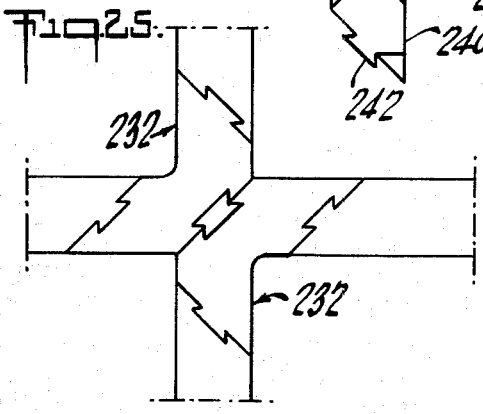
FIGS. 25, 26 show the accessory forms of FIGS. 22, 23 arranged to provide a cross-over or a 90° TEE.
Figure 26:
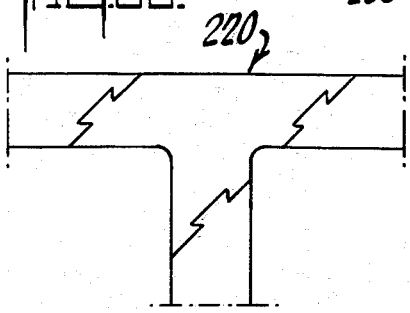

Referring now to FIGS. 22 and 23 which are considered to be additional accessory forms for giving additional versatility to the standard form in the erection of structures. In particular there is shown in FIG. 22 a T-shaped configured form, 220 having a side 222 at right angles to side 224, the side 222 terminating in male-female miter 226, 228 respectively, and side 224 terminating in female miter 230. Likewise FIG. 23 shows an L-shaped configured form 232 with side 234 terminating in female miters 236, 238 and wall side 240, terminating in male miter 242. Both forms 220, 232 are so configured as to create any number of shapes when combined together as shown FIG. 24. The assembly of forms 220 and 232 may produce a structure 244 as shown in FIG. 24, which depicts a plurality of conduits 246 for the transport of various utilities. The same forms 220 and 232 as shown in FIGS. 25 and 26 when combined may effect a cross-over or a bridged-T for the structure.

Figure 27:
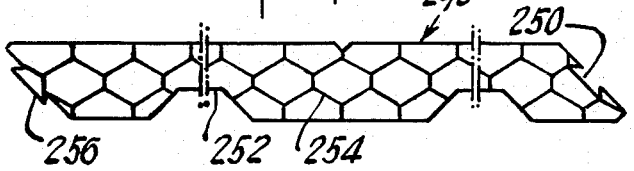
FIG. 27 is a relatively thin transparent paneling wall whose end parts terminate in a thicker form having male-female miters which reinforce the walls.
Figure 28:
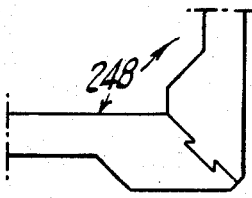
FIG. 28 is similar to FIG. 27 except the walls run at right-angles to each other rather than in a single continuous plane.

The various forms and accessories herein described may have their extremities covered by any available convenient means so that the internal structure of the forms will not be observed, thus providing a more finished look of the wall. Also as shown in FIGS. 27, 28—that any relatively thin wall wall panelling may have its extremities terminate in one of the forms described herein so that the end miters male-female may attach the panels. The forms render rigidity to the thin paneling and makes for easy construction.

Having described the invention what is claimed is:

1. Prefabricated structural assembly composed of interconnected construction forms and comprising, (a) standard construction forms in the form of shells having side walls and biased end terminations, (b) extrudable shells disposed to fit within the said forms, said shells having separate cells and support members for the transmission of cables, fluids and other utility carriers, and (c) solidifying means within the said forms between the said shells and forms to maintain their spaced relationship upon solidification of the said solidifying means.

2. Prefabricated structural assembly as per claim 1 and wherein said end terminations include male-female miters for the interconnection of said forms.

3. Prefabricated structural assembly as per claim 1, and wherein said shells includes spaced-apart support members disposed to separate cells and render same accessable to the transmission of fluids, cables and other utility carriers.

4. Prefabricated structural assembly as per claim 1, and wherein said solidifying means includes polyurethane foam disposed to solidify upon exposure to atmospheric conditions.

* * * * *